US005702191A

United States Patent [19]

Kakizaki et al.

[11] Patent Number: 5,702,191

[45] Date of Patent: Dec. 30, 1997

[54] SHEET FEEDING FORCE CONTROL IN A MULTIPLE INPUT PATH SHEET FEEDING APPARATUS

[75] Inventors: Masaaki Kakizaki, Kawasaki; Hirofumi Hirano, Yokohama; Toshihiko Bekki, Kawasaki, all of Japan

[73] Assignee: Canon Kabushiki Kaisha, Tokyo, Japan

[21] Appl. No.: 353,392

[22] Filed: Dec. 2, 1994

Related U.S. Application Data

[63] Continuation of Ser. No. 39,688, Mar. 29, 1993, abandoned, which is a continuation of Ser. No. 645,483, Jan. 24, 1991, abandoned.

[30] Foreign Application Priority Data

Jan. 30, 1990 [JP] Japan ..... 2-020150
Jan. 30, 1990 [JP] Japan ..... 2-020151

[51] Int. Cl.[6] ..... B41J 11/50

[52] U.S. Cl. ..... 400/582; 400/583.4; 400/605; 271/9.13; 347/101

[58] Field of Search ..... 400/578, 582, 400/583.4, 595, 596, 600, 602, 603, 605, 607.2, 634, 636, 636.2, 636.3, 637, 638, 639, 639.1, 641, 568, 583, 624, 625, 629; 347/101, 104; 271/9.01, 9.03

[56] References Cited

U.S. PATENT DOCUMENTS

| | | | |
|---|---|---|---|
| 3,508,637 | 4/1970 | Hull et al. | 400/583.4 |
| 4,056,183 | 11/1977 | Beery | 400/636 |
| 4,341,480 | 7/1982 | Mailer | 400/625 |
| 4,630,814 | 12/1986 | Kawakubo | 400/639.1 |
| 4,729,557 | 3/1988 | Kiyohara | 400/634 |
| 4,732,501 | 3/1988 | Angst | 400/902 |
| 4,773,782 | 9/1988 | Hirano | 400/637 |
| 4,909,149 | 3/1990 | Melcher | 400/583.4 |
| 4,909,649 | 3/1990 | Okunomiya et al. | 400/583.4 |
| 5,018,889 | 5/1991 | Oyaide et al. | 400/636 |

FOREIGN PATENT DOCUMENTS

| | | | |
|---|---|---|---|
| 0241769 | 10/1987 | European Pat. Off. . | |
| 0295969 | 12/1988 | European Pat. Off. . | |
| 2716396 | 10/1978 | Germany | 400/605 |
| 3509738 | 9/1985 | Germany . | |
| 18282 | 1/1982 | Japan | 400/605 |
| 67182 | 4/1985 | Japan | 400/639.1 |
| 242086 | 12/1985 | Japan | 400/902 |
| 77964 | 4/1987 | Japan | 400/583.4 |
| 227672 | 10/1987 | Japan | 400/708 |
| 63-120665 | 5/1988 | Japan | 400/583.4 |
| 137865 | 6/1988 | Japan | 400/583.4 |
| 246625 | 10/1988 | Japan | 400/605 |
| 1-042269 | 2/1989 | Japan | 400/583.4 |
| 1-195075 | 8/1989 | Japan | 400/583.4 |
| 2011321 | 7/1979 | United Kingdom | 400/639.1 |
| 2172549 | 9/1986 | United Kingdom . | |

*Primary Examiner*—David A. Wiecking
*Attorney, Agent, or Firm*—Fitzpatrick, Cella, Harper & Scinto

[57] ABSTRACT

A sheet feeding apparatus includes a conveyor for applying a conveying force to a sheet, a first guide for guiding the sheet to which the conveying force is applied from the conveyor, a second guide for guiding the sheet guided by the first guide along a curved path, a driver for driving the conveyor, and a controller for controlling the driver to increase the conveying force of the conveyor when the sheet being conveyed by the conveyor is guided with being abutted against the second guide.

53 Claims, 9 Drawing Sheets

| |
|---|
| FIG. 5A |
| FIG. 5B |

SHEET FEEDING FORCE CONTROL IN A MULTIPLE INPUT PATH SHEET FEEDING APPARATUS

This application is a continuation of application Ser. No. 08/039,688, filed Mar. 29, 1993, now abandoned, which was a continuation of application Ser. No. 07/645,483, filed Jan. 24, 1991, now abandoned.

BACKGROUND OF THE INVENTION

1. Field of the Invention

The present invention relates to a sheet feeding apparatus which can feed or convey a sheet accurately, and a recording system using such sheet feeding apparatus.

2. Related Background Art

Nowadays, word processors and personal computers have been widely popularized and various recording systems for outputting information from such equipment have also been developed. Pursuant to this, various kinds of sheet feeding apparatuses used with such recording systems have been put to practical use.

As an example, a conventional ink jet recording system is shown in FIG. 11. In this recording system, a sheet 50 such as plain paper or plastic sheet is supplied from anASF (auto-sheet feeder) 51 by means of a supply roller (not shown) and is directed to a nip between a conveying roller 53 (temporarily stopped) and a pinch roller 54 by an upper guide 55 while being guided by a paper pan 52 until a leading end of the sheet abuts against the nip, thereby positioning the leading end of the sheet. Then, by rotating the conveying roller 53 by means of an appropriate driving means (not shown), the sheet 50 is conveyed onto a platen 56 being guided by the paper pan 52, and the sheet is fixedly positioned on the platen by means of a hold-down plate 57. In this condition, by discharging ink from a recording head 59 mounted on a reciprocable carriage 58 in response to an image signal, an image is formed on the sheet 50.

In such a sheet feeding apparatus, if a thicker sheet such as an envelope is to be conveyed, since the thicker sheet has a strong resilience so that the sheet cannot be wrapped around the conveying roller, it is difficult to convey the Sheet accurately.

Thus, as shown in FIG. 12, there has been proposed a sheet feeding apparatus for conveying a thicker sheet in a straight feeding path. In this apparatus, the length of a paper pan 60 is reduced and the number of pinch rollers is also reduced, so that the thicker sheet can be supplied by means of a supply roller (not shown) from the bottom of the apparatus, whereby the thicker sheet 50 is conveyed without bending the sheet. That is to say, regarding a thin sheet 50, it is supplied from the ASF 51 to be wrapped around the conveying roller 53 as mentioned above; whereas, regarding the thicker sheet 50, it is inserted from a supply opening 62 formed in the bottom of the apparatus, and, by rotating the conveying roller 53 and urging the sheet against the conveying roller by means of a hold-down plate 63, the sheet is brought straight in front of a discharging face of the recording head 59.

However, with the arrangement wherein the sheet supply opening 62 is formed between the paper pan 60 and the hold-down plate 63, since there is a clearance between the paper pan 60 and the hold-down plate 63, when the sheet 50 is conveyed and wrapped around the conveying roller 53, an incident angle of the sheet to the hold-downplate 63 becomes great. Consequently, the leading end of the sheet 50 is apt to strike against the sheet hold-down plate 63. If the leading end of the sheet strikes against the hold-down plate, there arises a great conveying load in the sheet feeding operation, which results in the poor registration of the sheet 50 in the recording operation, thus causing a problem that a recording start position is not uniform or not consistent.

SUMMARY OF THE INVENTION

An object of the present invention is to provide a sheet feeding apparatus which can solve the above-mentioned conventional problem, can feed a sheet accurately even when a leading end of the sheet strikes against a sheet hold-down plate and can obtain the correct registration of the sheet in a recording position, thus permitting the recording of an image with high quality, and to provide a recording system using such sheet feeding apparatus.

DETAILED DESCRIPTION OF THE PREFERRED EMBODIMENTS

The present invention will now be explained in connection with an embodiment thereof applied to a bubble jet recording system.

Figure 1:
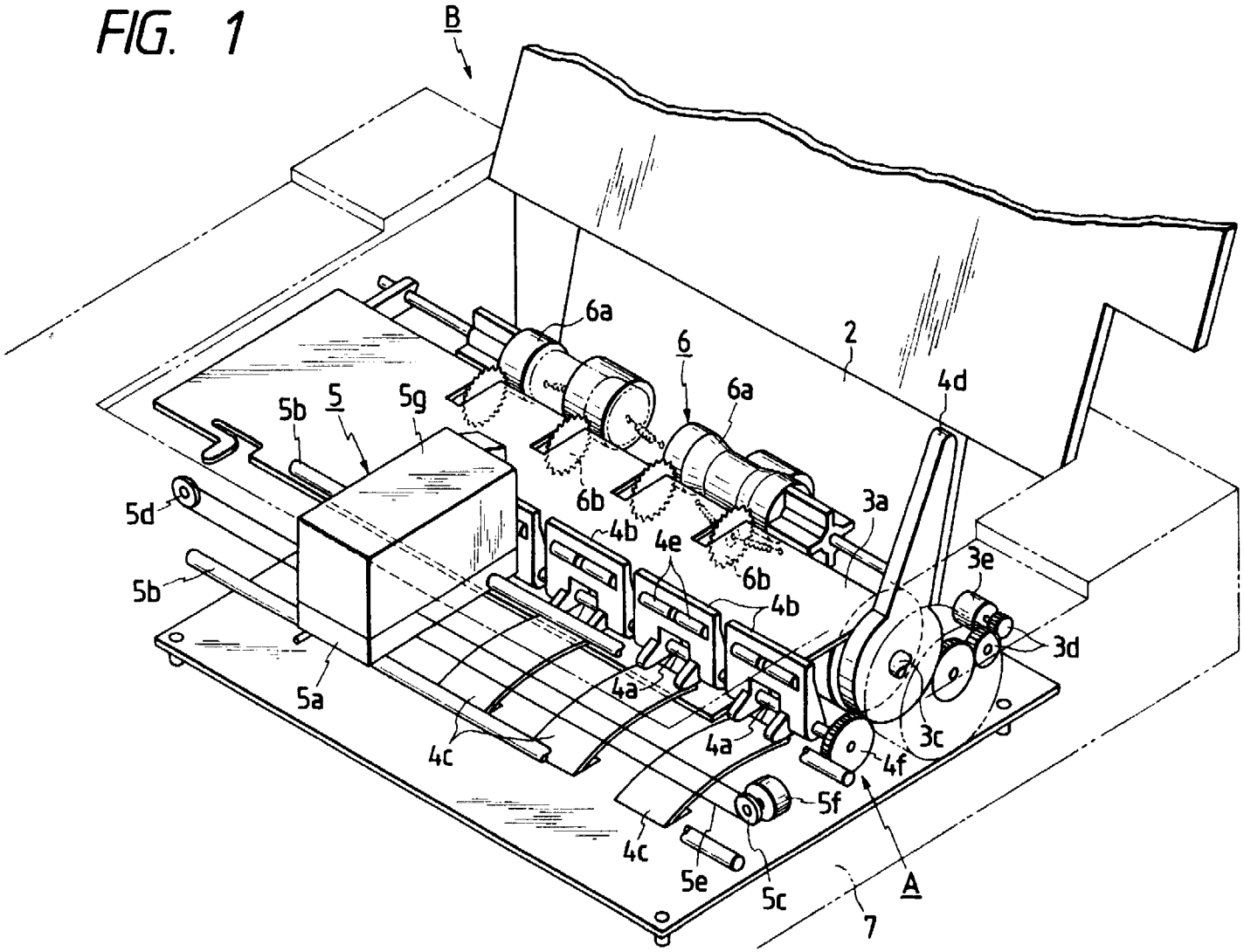
FIG. 1 is a perspective view of a sheet feeding apparatus according to a preferred embodiment of the present invention.
Figure 2:
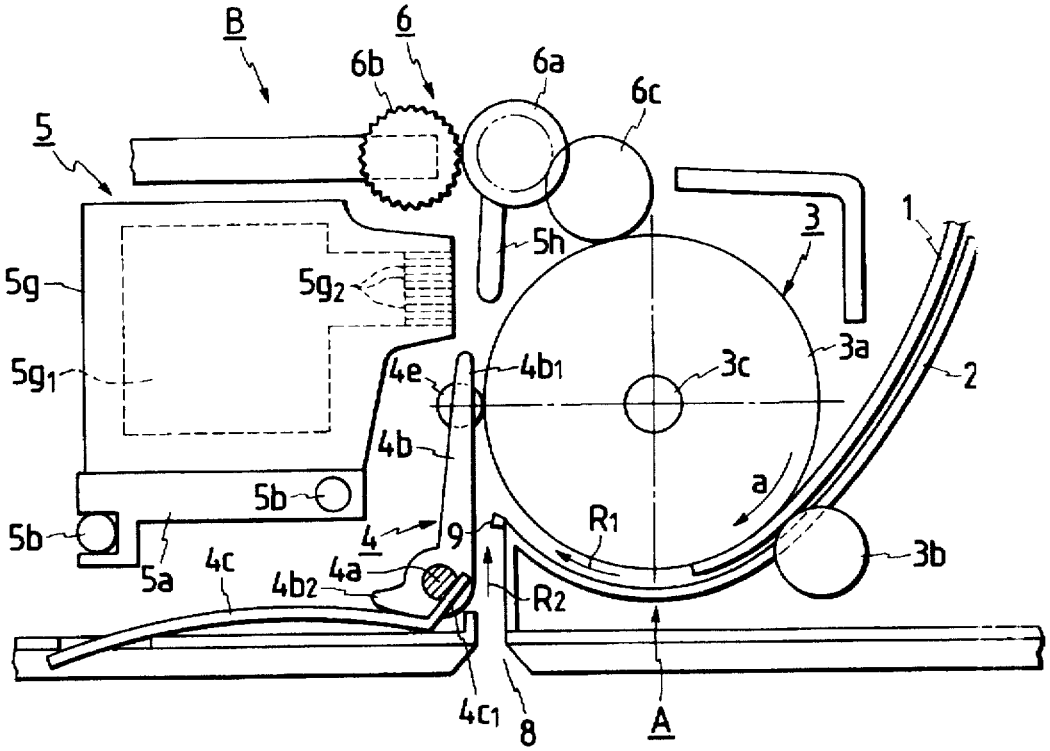
FIG. 2 is an elevational sectional view of the apparatus of FIG. 1.

FIG. 1 is a perspective view of a main part of a bubble jet recording system B of a serial type utilizing a sheet feeding apparatus A and FIG. 2 is an elevational sectional view of such a recording system.

Whole Construction

First, the entire construction of the recording system B will he described. A recording sheet 1 obtained by cutting the plastic sheet material to a predetermined size is supplied from an ASF (not shown) and is conveyed by being guided by a paper pan (sheet guide means) 2. When a conveying roller 3*a* constituting a sheet conveying force application means 3 is rotated in a direction shown by the arrow a in FIG. 2, this roller cooperates with a pinch roller 3*b* to apply a conveying force to the recording sheet 1. Thus, the recording sheet 1 is fed through a first feeding path $R_1$ by being wrapped around the conveying roller 3a, and then is conveyed to a recording position for a recording means 5 by being urged against a surface of the conveying roller 3a by means of a sheet hold-down means 4.

The recording means 5 records an image on the recording sheet 1 conveyed to the recording position, and the recorded sheet is ejected out of the recording system by means of a sheet discharging means 6.

Incidentally, in conveying the recording sheet, when the recording sheet 1 is conveyed by being wrapped around the conveying roller 3a, the rotating speed of the conveying roller 3a is slowed down only in a given time period before and after a leading end of the recording sheet 1 abuts against the sheet hold-down means 4, as will be described later.

On the other hand, a thicker recording sheet 1 is conveyed to the recording position straight through a second sheet feeding path $R_2$ without bending the sheet, and the recording is effected on the thicker sheet in the same manner.

Next, the construction of various elements of the recording system will be described.

Sheet Conveying Force Application Means

The sheet conveying force application means 3 serves to apply a conveying force to the recording sheet 1 and is constituted by the conveying roller 3a in the illustrated embodiment.

The conveying roller 3a comprises a cylinder made of aluminium material and having a predetermined outer diameter, and a urethane layer coated on an outer surface of the cylinder. The conveying roller has a roller shaft 3c rotatably mounted on a chassis 7. As shown in FIG. 1, the roller shaft 3c is connected to a convey motor (stepping motor) 3e through a reduction gear train 3d.

The pinch roller 3b comprising a plurality of roller elements aligned in an axial direction is urged against the surface of the conveying roller 3a by means of a bias spring and the like (not shown) so that the pinch roller can be driven synchronously with the rotation of the conveying roller 3a. Thus, when the convey motor 3e is activated to rotate the conveying roller 3a in the direction shown by the arrow a in FIG. 2, the recording sheet 1 is pinched between the conveying roller 3a and the pinch roller 3b, so that these rollers cooperate with each other to apply the conveying force to the recording sheet.

Sheet Guide Means

The sheet guide means serves to guide the recording sheet 1 conveyed by the rotation of the conveying roller 3a in such a manner that the recording sheet 1 is wrapped around the conveying roller 3a. In the illustrated embodiment, the sheet guide means comprises the paper pan 2.

As shown in FIG. 2, the paper pan 2 is made of a metal plate and has a curved portion complementary to the outer surface of the conveying roller, which curved portion is spaced apart from the outer peripheral surface of the conveying roller 3a by a predetermined distance so as to provide the first sheet feeding path $R_1$ for the recording sheet 1. Thus, the recording sheet 1 introduced into the first sheet feeding path $R_1$ is subjected to the conveying force due to the rotation of the conveying roller 3a and is guided by the paper pan 2 to be fed along the outer peripheral surface of the conveying roller 3a.

Sheet Hold-down Means

The sheet hold-down means 4 serves to prevent the recording sheet 1 from floating off from the conveying roller 3a. In the illustrated embodiment, as shown in FIG. 2, the sheet hold-down means comprises a plurality of hold-down members 4b rotatably mounted on and aligned along a shaft 4a supported by the chassis 7. Each hold-down member 4d is biased by a corresponding leaf spring 4c attached to the chassis 7, in such a manner that a free end 4b, of the hold-down member is urged against the surface of the conveying roller 3a. Such a biasing mechanism will be fully described with reference to FIGS. 3A and 3B.

Figure 3A:
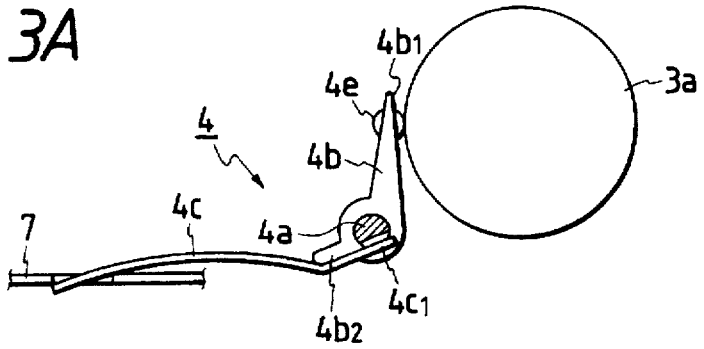
FIGS. 3A and 3B are explanatory views showing a sheet urging mechanism.

FIG. 3A shows a condition that the sheet hold-down means 4 is positively urged against the conveying roller 3a. The shaft 4a has a semi-circular cross-section including a flat cut-out portion. In the condition as shown in FIG. 3A, the cut-out portion faces a free end $4c_1$ of the leaf spring 4c so that a base end $4b_2$ of the hold-down member 4b is biased upwardly (FIG. 3A) by the leaf spring 4c. Thus, the hold-down member 4b tends to rotate in a clockwise direction around the shaft 4a to apply an urging force onto the conveying roller 3a.

Figure 3B:
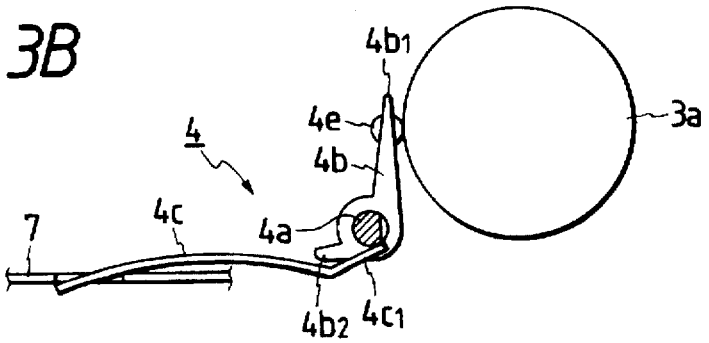

On the other hand, FIG. 3B shows a condition that the urging force of the hold-down means 4 is released. In this condition, the shaft 4a is rotated to separate the cut-out portion from the free end $4c_1$ of the leaf spring 4c (i.e., a cylindrical outer surface of the shaft 4a contacts the free end $4c_1$). Thus, the leaf spring 4c is wholly pressed downwardly (FIG. 3B), with the result that the base end $4b_2$ of the hold-down member 4b is not subjected to the biasing force from the leaf spring 4c.

In this biasing force released condition, since the hold-down members 4b are held on the shaft 4a due to the friction force therebetween, the hold-down members 4b are not angularly displaced in a great extent. Thus, even when it is required to release the urging force of the hold-down members 4b, the latter do not interfere with the movement of a record head which will be described later.

Incidentally, the releasing of the urging force of the hold-down members is advantageously performed by rotating the shaft 4a by manipulating a release lever 4d connected to the shaft 4a through a gear 4f, as shown in FIG. 1. Further, the biasing force of the leaf springs 4c can be optionally set by adjusting the length of the leaf springs 4c.

Further, the free end $4b_1$ (which is urged against the conveying roller 3a) of each hold-down member 4b is provided with a needle roller 4e which is urged against the surface of the conveying roller 3a. Each needle roller 4e is rotatably mounted on the corresponding hold-down member and is driven synchronously with the rotation of the conveying roller 3a.

In the illustrated embodiment, as mentioned above, since the urethane layer is coated on the outer surface of the conveying roller 3a, the frictional coefficient of the surface of the conveying roller will greatly vary in accordance with the change in the surrounding conditions such as temperature and/or humidity. For example, under a high temperature and high humidity condition, the frictional coefficient of the surface of the conveying roller 3a becomes high, and, in this case, if each hold-down member 4b directly contacts the conveying roller 3a, when the latter is rotated, the rotation load will be great. To the contrary, in the illustrated embodiment of the present invention, since, as mentioned above, the needle rollers 4e contact the conveying roller 3a, even if the frictional coefficient of the surface of the conveying roller becomes high, the conveying roller 3a can be rotated with a small load, thus preventing a severe load from acting on the convey motor 3e.

Recording Means

Next, the recording means 5 will be explained. As shown in FIGS. 1 and 2, the recording means 5 according to the illustrated embodiment utilizes a bubble jet recording mechanism of the serial type.

A carriage 5a is slidably supported on guide rails 5b both ends of which are fixedly attached to the chassis 7. The carriage 5a is connected to a timing belt 5e extending between and entrained around a driving pulley 5c and a driven pulley 5d, and the driving pulley 5c is connected to a carriage motor 5f. Accordingly, when the carriage motor 5f is rotated normally and in a reverse direction, the carriage 5a is reciprocally shifted along the guide rails 5b.

A record head 5g is mounted on the carrriage 5a. As shown in FIG. 2, the record head 5g has an ink reservoir $5g_1$ filled with ink, and a number of ink passages $5g_2$ aligned in a line along a vertical direction of FIG. 2. The ink contained in the ink passages $5g_2$ is maintained therein in a normal condition due to the fact that the surface tension of the ink equilibrates or balances with the external force at an orifice surface. Further, an electrical/thermal converter (not shown) is disposed in each ink passage $5g_2$. Thus, by selectively energizing the electrical/thermal converters in response to an image signal, the ink is discharged from the orifices (corresponding to the ink passages associated with the energized electrical/thermal converters), thus recording an ink image on the recording sheet 1.

More particularly, when the electrical/thermal converter is energized, the temperature of the ink contained in the associated ink passage $5g_2$ is increased rapidly to exceed the nucleate boiling point of the ink, thus vaporizing the ink to create film boiling. Consequently, a bubble is generated in the ink passage $5g_2$, and, by the growth of the bubble, an ink droplet is discharged from the orifice surface toward the recording sheet 1, thus recording the ink image on the recording sheet. Then, when the electrical/thermal converter is deenergized, the bubble in the ink passage $5g_2$ is cooled by the ink to be contracted, with the result that new ink is replenished in the ink passage $5g_2$ from the ink reservoir $5g_1$ by a capillary phenomenon, thereby preparing for the next energization of the electrical/thermal converter. Therefore, by selectively energizing the electrical/thermal converters in response to the image signal in synchronously with the movement of the carriage 5a, it is possible to record the whole ink image on the recording sheet 1.

Incidentally, a platen 5h is arranged in confronting relation to the orifice surface of the record head 5g to support the back surface of the recording sheet 1. The recording sheet 1 subjected to the conveying force due to the rotation of the conveying roller 3a is introduced between the record head 5g and the platen 5h. However, since the recording sheet is pressed by the sheet hold-down means 4, the back surface of the recording sheet does not float from the platen 5h, thereby always maintaining a constant distance between the orifice surface and the recording sheet 1.

Sheet Dicharging Means

The recording sheet 1 on which the ink image is recorded as mentioned above is ejected out of the recording system by means of the sheet discharging means 6. In the illustrated embodiment, the sheet discharging means 6 comprises ejector rollers 6a and spurs 6b abutted against the corresponding ejector rollers. Transmission rollers 6c are disposed between the corresponding ejector rollers 6a and the conveying roller 3a, so that, when the conveying roller 3a is rotated, the rotation force of the conveying roller is transmitted to the ejector rollers 6a through the transmission rollers 6c.

As shown in FIG. 1, each ejector roller 6a has a central portion of a reduced diameter and end portions of large diameter, and the corresponding transmission roller 6c abuts against the reduced diameter central portion. Accordingly, the large diameter end portions (which contribute to the feeding of the recording sheet 1) of the ejector roller 6a are rotated at a peripheral speed slightly faster than the peripheral speed of the conveying roller 3a. Consequently, in ejecting the recording sheet, the ejector rollers 6a pull the recording sheet 1, thus preventing the distortion of the recorded image.

Sheet Feeding Path

As mentioned above, the sheet feeding paths comprises the first sheet feeding path $R_1$ through which the recording sheet is conveyed to the recording means 5 by being guided by the paper pan 2 and being wrapped around the conveying roller 3a, and the second sheet feeding path $R_2$ for feeding the thicker recording sheet 1.

In the illustrated embodiment, as shown in FIG. 2, the second sheet feeding path $R_2$ has an sheet inlet opening 8 formed in the bottom of the system. The thicker recording sheet 1 inserted from the sheet inlet opening 8 is conveyed to the recording position by the rotation of the conveying roller 3a by being urged against the conveying roller by means of the sheet hold-down means 4.

The sheet inlet opening 8 is disposed on a substantially straight line connecting the sheet discharging means 6 to the recording means 5. Thus, the second sheet feeding path $R_2$ is formed generally straight, so that the recording sheet 1 is not subjected to resistance due to its own resilience and is conveyed generally straight.

Incidentally, at an end of the paper pan 2 where the first sheet feeding path $R_1$ is joined with the second sheet feeding path $R_2$, there is arranged a sheet sensor 9 for detecting the presence of the recording sheet 1 in the first or second sheet feeding path. The sheet sensor 9 emits an ON signal when it detects the recording sheet 1 and emits an OFF signal when it does not detect the recording sheet. Further, the sheet sensor 9 is pivotably supported so that it can pivot or rock so as not to interfere with the recording sheet conveyed in the first or second sheet feeding path $R_1$, $R_2$.

Control Means

Next, the control means for controlling the driving of the above-mentioned elements will be explained.

Figure 4:
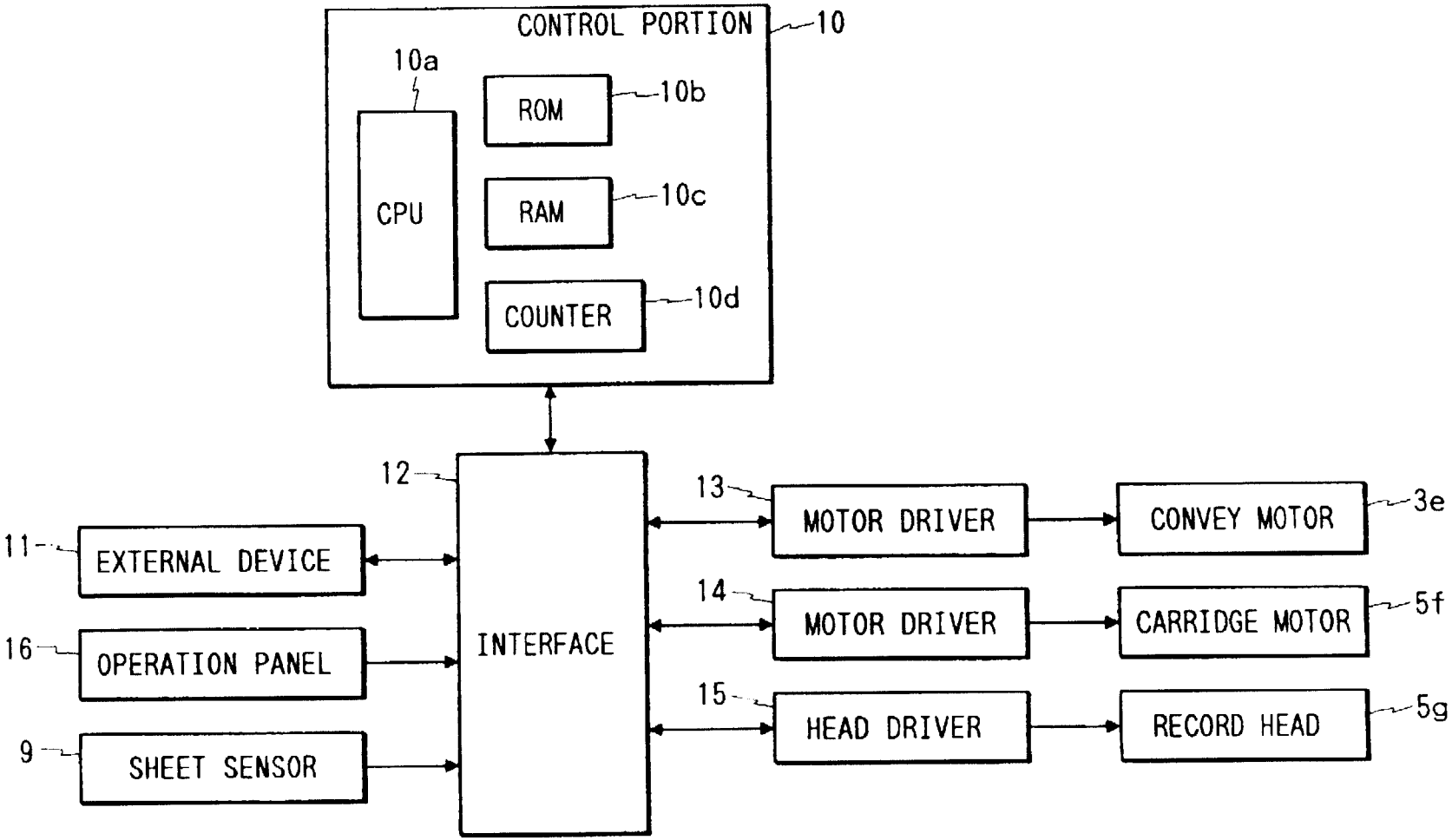
FIG. 4 is a block diagram of a control system.

FIG. 4 shows a block diagram of a control system, where a control portion 10 for outputting drive control signals for the above-mentioned elements includes a CPU 10a, a ROM 10b, a RAM 10c and a counter 10d.

The CPU (central processing unit) 10a reads out the programs or various data from the ROM 10b, performs the necessary calculations and judgements, and carries out various controls. The ROM (read-only memory) 10b stores the various programs and character codes necessary for activating the CPU 10a, and the various data necessary for dot pattern recording and the like.

The RAM (random access memory) 10c includes a working area where the data commanded by the CPU and/or calculated results obtained by the CPU are temporarily stored, or a buffer area for storing various data inputted from an external device 11 and the like. The counter 10d counts the number of driving pulses of the convey motor 3e and transmits such information to the CPU.

The control portion 10 receives the image signal from the external device 11, a sheet detection signal from the sheet sensor 9 and a command signal from an operation panel 16 through an interface 12. Further, the control portion 10 sends the driving signals to motor drivers 13, 14 for driving the convey motor 3e and the carriage motor 5f and also sends the driving signal to a head driver 15 for driving the record head 5g on the basis of the program.

There are two convey modes for sending or outputting the driving signal to the convey motor 3e. The first convey mode is an auto-paper set mode used when the recording sheet 1 is conveyed through the first sheet feeding path $R_1$ and the second convey mode is used when the recording sheet is conveyed through the second sheet feeding path $R_2$. An operator can select either the first or second mode by means of the operation panel 16.

Figures 5, 5A:
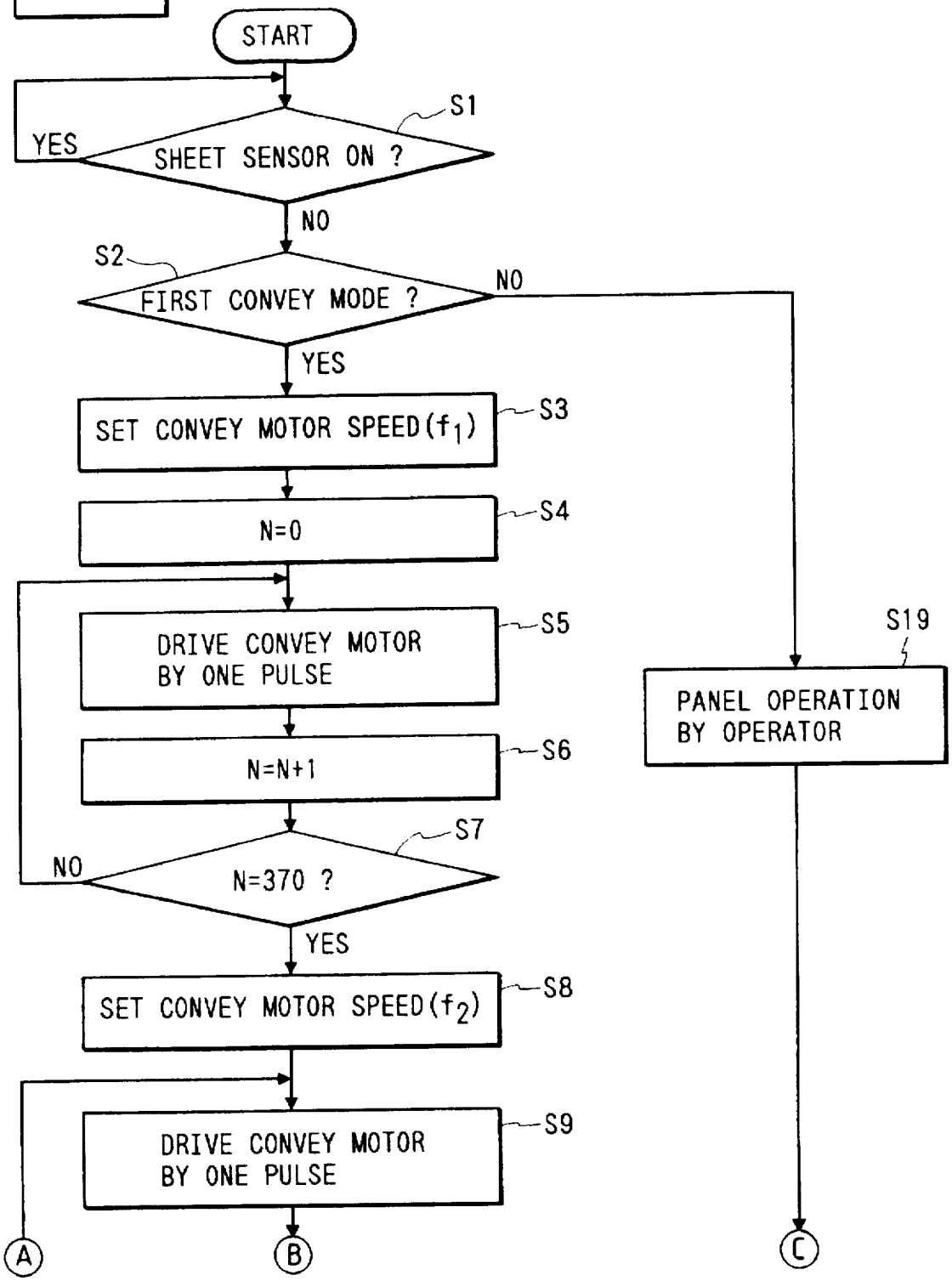
FIG. 5 is a flow chart showing a sheet feeding sequence.
Figure 5B:
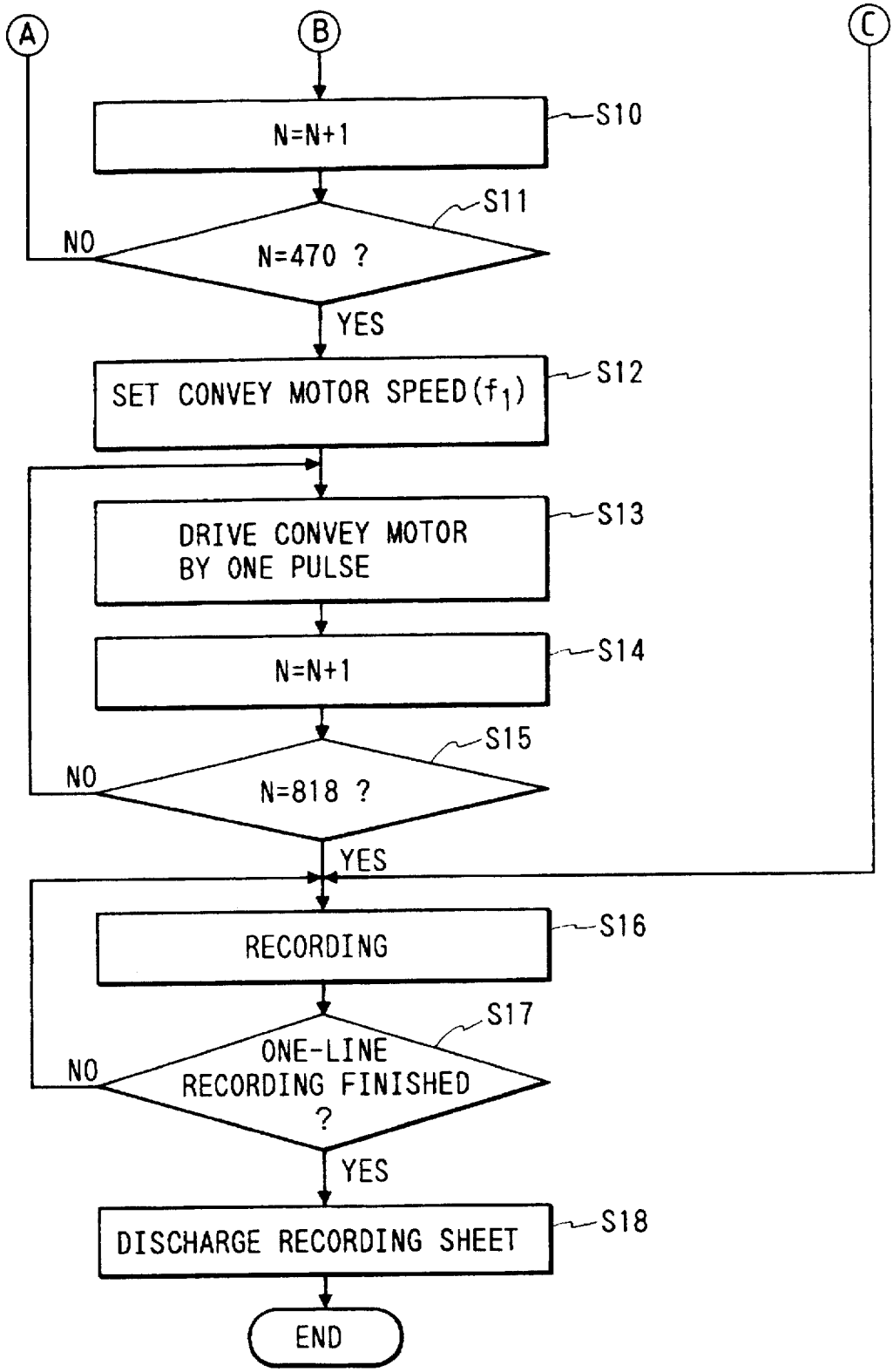

Next, the control sequence for conveying the recording sheet 1 by means of the control means and recording the image on the recording sheet will be explained with reference to a flow chart of FIG. 5 and a timing chart of FIG. 6.

First of all, in a step S1, it is determined whether the sheet sensor 9 is turned ON or not. If the sheet sensor 9 is turned ON, since the recording sheet is in the sheet feeding path, a new recording sheet is not supplied. To the contrary, if the sensor 9 is turned OFF, since the recording sheet 1 does not exist in the sheet feeding path and there is established a condition that the recording sheet is being ejected or a condition that the recording operation regarding the recording sheet is nearly finished, the sequence will entail a waiting condition until the recording sheet 1 is completely ejected out of the recording system.

Figure 7:
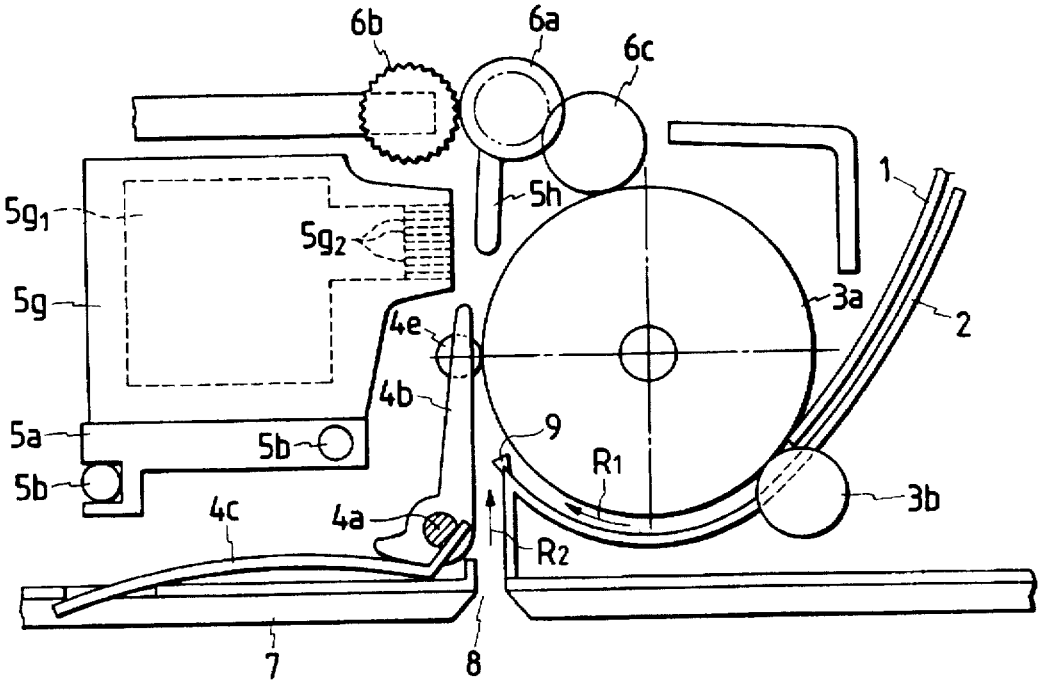
FIG. 7 is an elevational sectional view showing a condition that the sheet abuts a nip between a conveying roller and a pinch roller when the sheet is conveyed through the first sheet feeding path.

After the recording sheet 1 has been completely ejected from the recording system, in a step S2, it is determined whether the first convey mode is selected. If the first convey mode is selected, the convey motor 3e is driven to convey the recording sheet 1 urged against the nip between the conveying roller 3a and the pinch roller 3b as shown in FIG. 7. Incidentally, during this conveyance of the recording sheet, the convey motor 3e is driven to convey the recording sheet 1 at a speed slower than a normal conveying speed in a given time period before and after the leading end of the recording sheet 1 abuts against the sheet hold-down members 4b.

That is to say, in steps S3 to S7, the driving frequency of the convey motor 3e is so set that the sheet conveying speed becomes $f_1$ (pulse/sec), and the convey motor 3e is driven at that frequency by 370 pulses. In this case, as shown in FIG. 6, the sheet conveying speed is increased to the value $f_1$ by about the first or initial ten pulses, and the recording sheet 1 is wrapped around the conveying roller 3a and is conveyed by that roller at that conveying speed $f_1$.

Now, in the illustrated embodiment, a sheet conveying amount is so set that, when the convey motor 3e is driven by one pulse, the recording sheet i is advanced by 1/360 inch. Further, the length of the first sheet feeding path $R_1$ is so selected that, when the convey motor 3e is driven by 370 pulses, the leading end of the recording sheet 1 is positioned in the vicinity of the sheet hold-down members 4b.

Next, in steps S8 to S11, the driving frequency of the convey motor 3e is so set that the sheet conveying speed becomes $f_2$ (pulse/sec), slower than the aforementioned speed $f_1$, and the convey motor 3e is driven at that frequency by 470 pulses.

Figure 6:
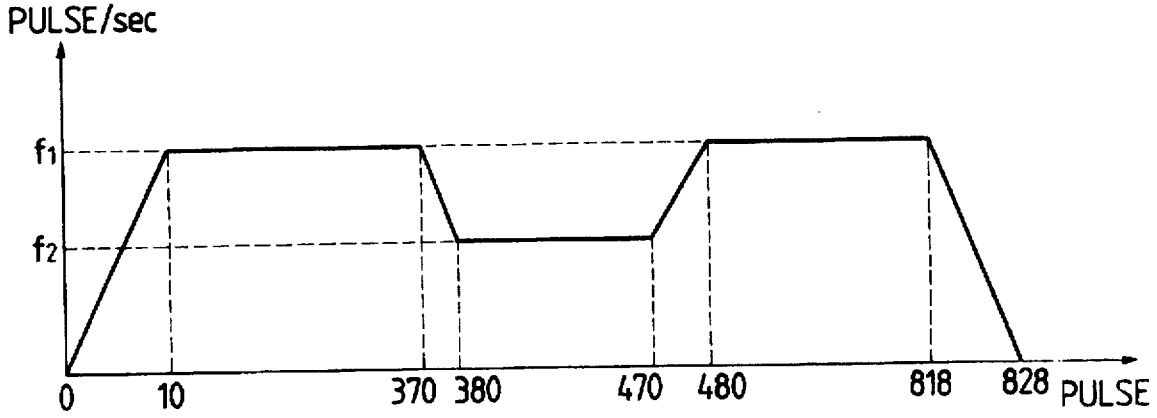
FIG. 6 is a timing chart showing a driving speed of a convey motor when a sheet is conveyed through a first sheet feeding path.
Figure 8:
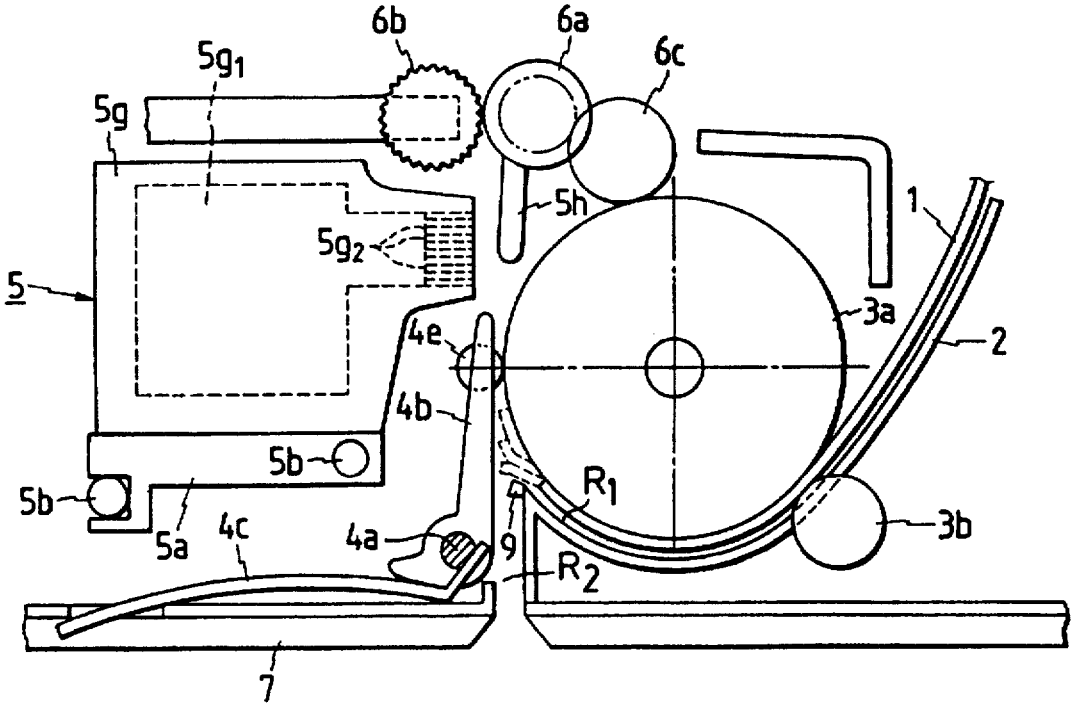
FIG. 8 is an elevational sectional view showing a condition that a leading end of the sheet strikes against a sheet hold-down plate.

In this case, as shown in FIG. 6, the sheet conveying speed is decreased to the value $f_2$ about ten pulses, and the leading end of the recording sheet 1 abuts against the sheet hold-down members 4b and is conveyed at that conveying speed $f_2$. More particularly, as shown in FIG. 8, since the second sheet feeding path $R_2$ is formed between the paper pan 2 and the sheet hold-down members 4b and there is a clearance between these elements 2 and 4b, the incident angle by which the leading end of the recording sheet 1 abuts against the sheet hold-down members 4b will become larger. Accordingly, a sheet conveying load will be increased in comparison with a normal sheet conveying load; however, in this case, since the driving speed of the convey motor 3e is slowed down, the driving torque of the convey motor will be increased.

Further, the peripheral speed of the conveying roller 3a is decreased and the friction between the recording sheet 1 and the conveying roller 3a is obtained in the form of the static friction which is larger than the dynamic friction, even if the sheet conveying load is increased as mentioned above, the large conveying force is applied to the recording sheet 1, thus positively conveying the recording sheet.

Incidentally, according to the illustrated embodiment, in the timing chart of FIG. 6, the length of the first sheet feeding path $R_1$ is so selected that the leading end of the recording sheet abuts against the sheet hold-down members 4b at about the 380th pulse. That is to say, the length or distance between the nip (between the conveying roller 3a and the pinch roller 3b) and the sheet hold-down members 4b is selected to have a value of about 380/360 inch. During 90 pulses from 380th pulse to 470th pulse (i.e., a distance of 90/360 (=¼) inch), the recording sheet 1 is conveyed at the speed $f_2$.

Then, in steps S12 to S15, the driving frequency of the convey motor 3e is so set that the sheet conveying speed is again increased to $f_1$ (pulse/sec), and the convey motor 3e is driven at that frequency up to 818th pulse. In this case, as shown in FIG. 6, the sheet conveying speed is increased to $f_1$ in about ten pulses, and the recording sheet 1 is conveyed at that speed until the leading end of the recording sheet reaches the recording position, thus completing the registration of the recording sheet.

Incidentally, during ten pulses from 818th pulse to 828th pulse, the convey motor 3e is braked to be stopped.

When the registration of the recording sheet 1 is completed as mentioned above, in a step S16, the predetermined recording operation is effected. The recording operation is the same as the standard serial recording operation, wherein the carriage 5a is shifted by energizing the carriage motor 5f and the record head 5g is driven to perform the recording operation by discharging the ink onto the recording sheet 1 in response to the image pattern. When one-line recording is finished, the convey motor 3e is driven to shift the recording sheet 1 by one line space, and the similar recording operation is repeated.

When the whole recording is finished regarding one recording sheet 1, the sequence goes from a step S17 to a step S18, where the recording sheet 1 is ejected or discharged by activating the convey motor 3e, thus finishing the sheet conveying operation and the recording operation.

Figure 9:
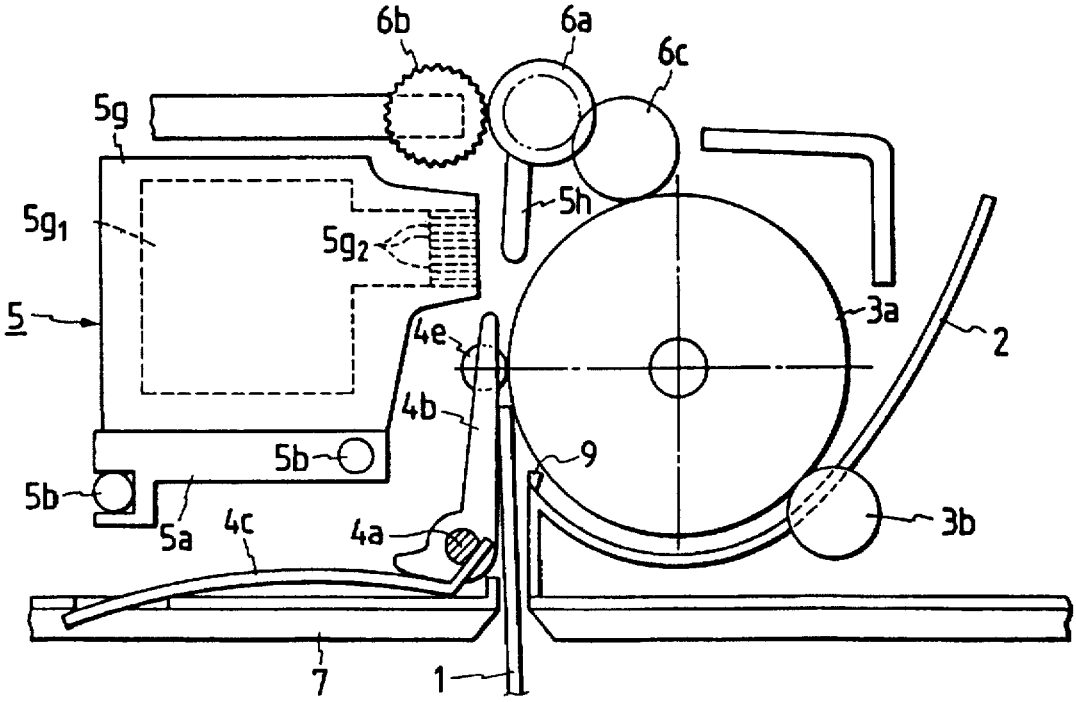
FIGS. 9 and 10 are elevational sectional views for explaining the manner in which the sheet is conveyed through a second sheet feeding path.

On the other hand, in the step S2, if the second conveying mode is selected, since the recording sheet 1 is conveyed straight through the second sheet feeding path $R_2$ as shown in FIG. 9, the recording sheet can be conveyed without decreasing the driving speed of the convey motor 3e as mentioned above.

Figure 10:
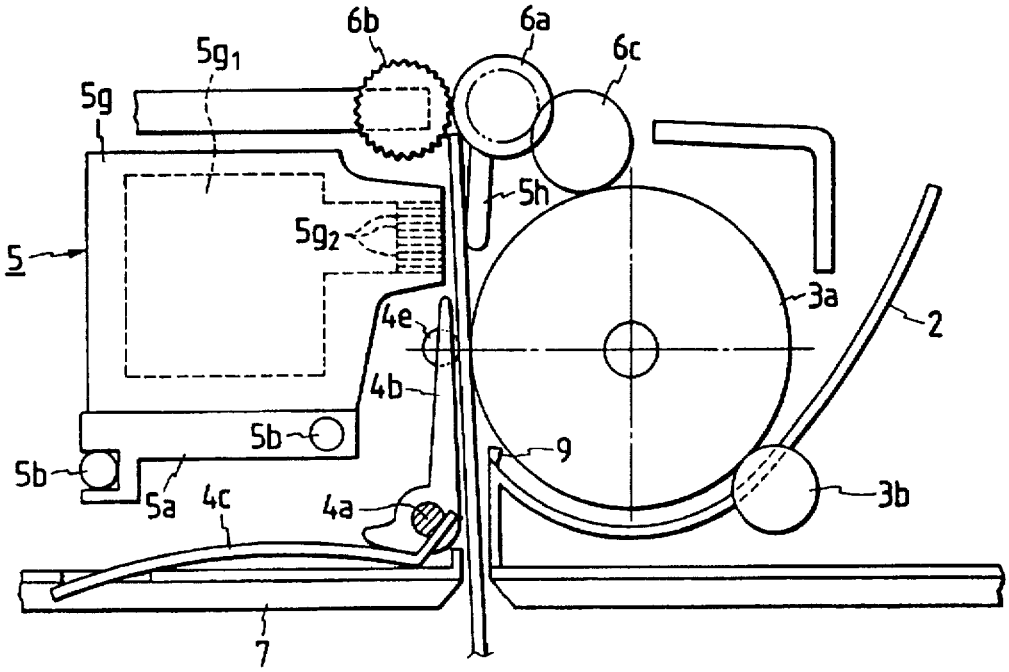
Figure 11:
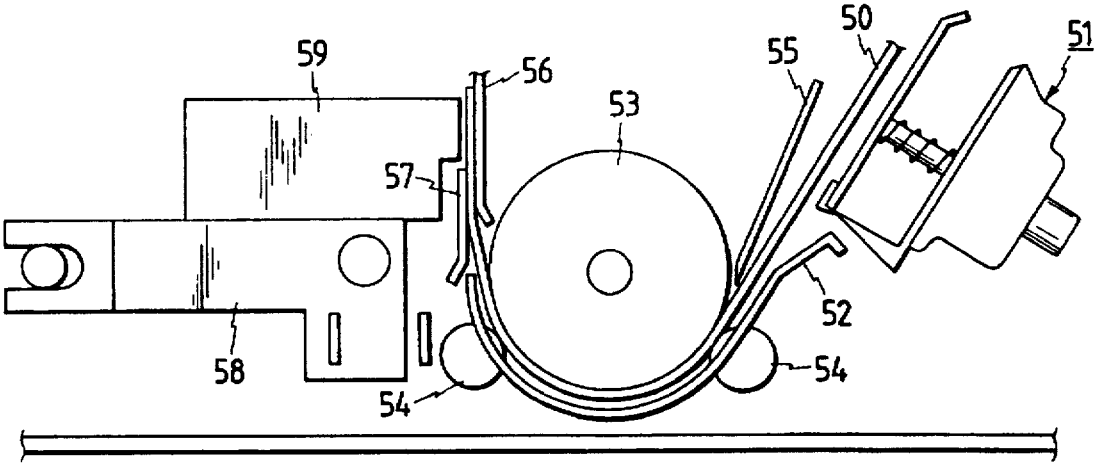
FIG. 11 PRIOR ART
FIGS. 11 and 12 are elevational sectional views of conventional sheet feeding apparatuses.
Figure 12:
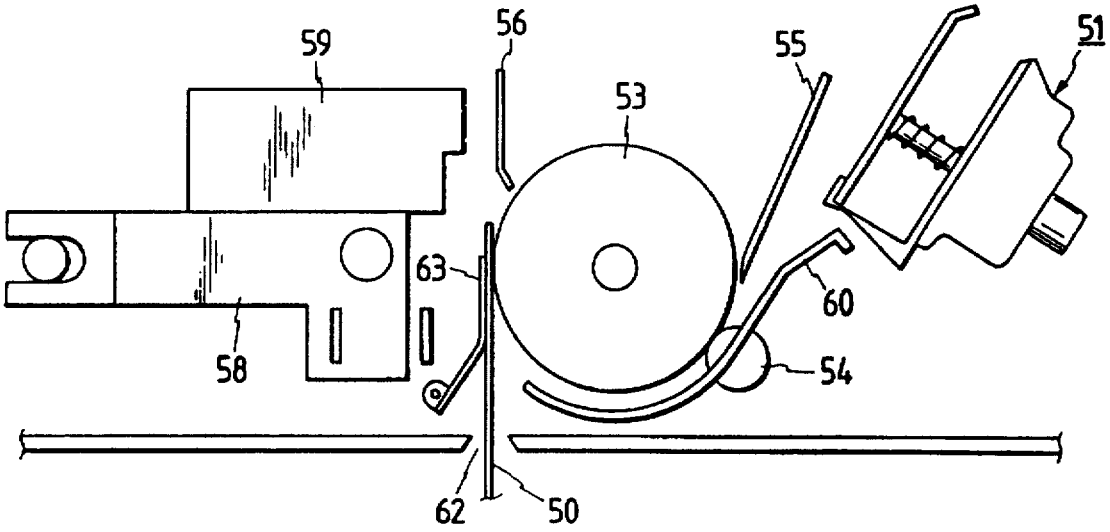
FIG. 12 PRIOR ART

That is to say, the sequence goes from the step S2 to a step S19, where the operator manipulates a line feed switch for 60 pulses and a fine-adjustment feed switch for two pulses through the operation panel 16 to drive the convey motor 3e while maintaining the sheet conveying speed to $f_1$, and adjusts so that the leading end of the recording sheet I reaches the recording position of the recording means 5 as shown in FIG. 10. And, by manipulating an ON line switch on the operation panel 16, the recording operation and the ejecting operation can be effected in the same manner as that described above.

Incidentally, in the above-mentioned embodiment, while the conveying force was applied to the recording sheet 1 by the conveying roller 3*a* acting as the sheet conveying force application means 3, this means is not necessarily limited to the roller, but may comprise, for example, a rotating belt and the like.

Further, while an example that the sheet feeding apparatus is used with the recording system was explained, the sheet feeding apparatus of the present invention may be used with other systems such as an image reading system and the like.

In addition, in the above-mentioned embodiment, while an example that the recording means 5 comprises the record head 5*g* integrally incorporating the ink reservoir $5g_1$ and the ink passages $5g_2$ was explained, the ink reservoir $5g_1$ may be formed independently from the record head 5*g* and may be mounted on the recording system.

Further, the recording means 5 is not limited to the bubble jet recording process, but may use an ink jet recording process. Alternatively, other recording processes such as a heat transfer recording process utilizing an ink sheet on which the heat-fusible ink is coated, a heat-sensitive recording process utilizing a heat-sensitive sheet, or a wire dot recording process may be used. Therefore, the record head 5*g* is not limited to the bubble jet head, but may comprise a thermal head, a wire dot head, or the like.

Furthermore, while an example that the recording means 5 is of a so-called serial type wherein the recording is effected by shifting the carriage 5*a* on which the record head 5*g* is mounted was explained, the recording means may be of a so-called line type wherein a record head having a length longer than a width of the recording sheet 1 is urged against the recording sheet 1 and the recording is effected with conveying the recording sheet 1.

Incidentally, in the illustrated embodiment, while an example that the rotating speed of the convey motor is slowed down to increase the conveying force of the conveying means was explained, it is not limited to this example. For example, when a DC motor is used as a drive means for driving the conveying means, a voltage and/or current supplied to the DC motor may be increased. Further, the drive means and the conveying means mat be interconnected through a mechanical driving force transmitting means such as a transmission capable of changing the speed reduction ratio, so that the conveying force can be increased by changing the speed reduction ratio.

What is claimed is:

1. A sheet feeding apparatus comprising:

conveying means having a convey roller for applying a conveying force to a sheet;

first guide means for guiding the sheet to which the conveying force is applied by said conveying means;

second guide means against which a tip end of the sheet guided by said first guide means abuts, for guiding the sheet in a direction changing an advancing direction of the sheet, and forming a first path together with said first guide means, wherein in the first path the sheet is conveyed by said conveying means;

third guide means, forming a second path joining to the first path at a position downstream of said first guide means and upstream of said second guide means, for guiding a sheet to said second guide means; and control means for controlling said conveying means so that the conveying force of said conveying means is increased from an initial value when a tip end of the sheet that is being guided by said first guide means reaches a first predetermined position upstream of said second guide means without interrupting sheet conveyance, and is returned to the initial value when the tip end of the sheet that is being guided by said second guide means reaches a second predetermined position downstream of an abut position where the sheet abuts said second guide means, thereby feeding the sheet to a third predetermined position under the initial conveying force.

2. A sheet feeding apparatus according to claim 1, wherein said control means increases the conveying force of said conveying means by decreasing the convey speed of said conveying means.

3. A sheet feeding apparatus according to claim 1, wherein said conveying means comprises a stepping motor.

4. A sheet feeding apparatus according to claim 1, wherein said conveying means includes a rotary conveying member a peripheral surface of which contacts the sheet.

5. A sheet feeding apparatus according to claim 1, wherein said first and second guide means guide the sheet along said conveying means.

6. A sheet feeding apparatus according to claim 4, wherein said second guide means has an urging portion which urges the sheet against said rotary conveying member.

7. A sheet feeding apparatus according to claim 1, wherein said drive means includes a driving force transmitting mechanism capable of changing a speed reduction ratio.

8. A sheet feeding apparatus according to claim 1, wherein said second guide means includes a driven rotary member which urges the sheet against said conveying means and which is driven by the sheet conveyed by said conveying means.

9. A sheet feeding apparatus according to claim 1, further including a recording means for recording an image on the sheet conveyed by said conveying means.

10. A sheet feeding apparatus according to claim 9, wherein said recording means includes an ink jet head for discharging ink.

11. A sheet feeding apparatus according to claim 10, wherein said ink jet head records the image with the ink discharged by thermal energy.

12. A sheet feeding apparatus according to claim 1, further comprising image forming means disposed downstream of said second guide means for forming an image to the sheet conveyed by said conveying means.

13. A sheet feeding apparatus comprising:

conveying means having a convey roller for applying a conveying force to a sheet;

first guide means for guiding the sheet to which the conveying force is applied by said conveying means;

second guide means against which a tip end of the sheet guided by said first guide means abuts, for guiding the sheet in a direction changing an advancing direction of the sheet and forming a first path together with said first guide means, wherein in the first path the sheet is conveyed by said conveying means;

third guide means, forming a second path joining to the first path at a position downstream of said first guide means and upstream of said second guide means, for guiding a sheet to a said second guide means; and control means for controlling said conveying means so that the conveying force of said conveying means is changed from a first convey force to a second convey force larger than the first convey force when a tip end of the sheet that is being guided by said first guide means reaches a first predetermined position upstream of said second guide means without interrupting sheet conveyance, and is changed to a third convey force smaller than the second convey force when a tip end of the sheet that is being guided by said second guide means reaches a second predetermined position downstream of an abut position where the sheet abuts said second guide means, to thereby feed the sheet to a third predetermined position under the third convey force.

14. A sheet feeding apparatus according to claim 13, wherein said control means increases the conveying force of said conveying means by decreasing the convey speed of said conveying means.

15. A sheet feeding apparatus according to claim 14, wherein said conveying means comprises a stepping motor.

16. A sheet feeding apparatus according to claim 13, wherein said first and second guide means guide the sheet along said conveying means.

17. A sheet feeding apparatus according to claim 13, wherein said conveying means includes a driving force transmitting mechanism capable of changing a speed reduction ratio.

18. A sheet feeding apparatus to claim 17, further including a recording means for recording an image on the sheet conveyed by said conveying means.

19. A sheet feeding apparatus according to claim 18, wherein said recording means includes an ink jet head for discharging ink.

20. A sheet feeding apparatus according to claim 19, wherein said ink jet head records the image with the ink discharged by thermal energy.

21. A sheet feeding apparatus according to claim 13, wherein said drive means comprises a motor.

22. A sheet feeding apparatus according to claim 21, wherein said control means changes the conveying force of said conveying means by changing an output of said motor.

23. A sheet feeding apparatus according to claim 22, wherein said control means sets the conveying force of said conveying means in the second convey force by increasing a voltage supplied to said motor.

24. A sheet feeding apparatus according to claim 13, further comprising image forming means disposed downstream of said second guide means for forming an image to the sheet conveyed by said conveying means.

25. An image forming apparatus comprising:

conveying means having a convey roller for applying a conveying force to a sheet;

first guide means for guiding the sheet to which the conveying force is applied by said conveying means;

second guide means, against which a tip end of the sheet guided by said first guide means abuts, for guiding the sheet in a direction changing an advancing direction of the sheet, and forming a first path together with said first guide means, wherein in the first path the sheet is conveyed by said conveying means;

third guide means forming a second path joining to the first path at a position downstream of said first guide means and upstream of said second guide means, for guiding the sheet to said second guide means;

image forming means disposed downstream of said second guide means for forming an image on the sheet conveyed by said conveying means; and control means for controlling said conveying means so that the conveying force thereof is increased from an initial value when a tip end of the sheet that is being guided by said first guide means reaches a first predetermined position upstream of said second guide means without interrupting sheet conveyance, and is returned to the initial value when the tip end of the sheet that is being guided by said second guide means reaches a second predetermined position downstream of an abut position where the sheet abuts said second guide means, to thereby feed the sheet to a third predetermined position under the initial conveying force.

26. A sheet feeding apparatus according to claim 25, wherein said recording means includes an ink jet head for discharging ink.

27. A sheet feeding apparatus according to claim 26, wherein said ink jet head records the image with the ink discharged by thermal energy.

28. A sheet feeding apparatus according to claim 1, wherein said conveying means comprises a motor.

29. A sheet feeding apparatus according to claim 13, wherein said drive means comprises a motor.

30. A sheet feeding apparatus according to claim 25, wherein said drive means comprises a motor.

31. A sheet feeding apparatus according to claim 13, wherein the third convey force is equal to the first convey force.

32. A sheet feeding apparatus, comprising:

conveying means for applying a conveying force to a sheet;

first guide means for guiding the sheet to which the conveying force is applied by said conveying means;

second guide means against which a tip end of the sheet guided by said first guide means abuts, for guiding the sheet in a direction changing an advancing direction of the sheet; and control means for controlling said conveying means so that the conveying force of said conveying means is changed from a first convey force to a second convey force larger than the first convey force when a tip end of the sheet that is being guided by said first guide means reaches a first predetermined position upstream of said second guide means without interrupting sheet conveyance, and is changed to a third convey force smaller than the second convey force when the tip end of the sheet that is being guided by said second guide means reaches to a second predetermined position downstream of an abut position where the sheet abuts said second guide means, to thereby feed the sheet to a third predetermined position under the third convey force.

33. A sheet feeding apparatus according to claim 32, wherein said control means changes the convey force by changing a convey speed for said conveying means.

34. A sheet feeding apparatus according to claim 33, wherein said conveying means has a stepping motor.

35. A sheet feeding apparatus according to claim 32, said conveying means has a rotary convey body having an outer peripheral surface in contact with the sheet.

36. A sheet feeding apparatus according to claim 32, wherein said first and second guide means guide the sheet along said conveying means.

37. A sheet feeding apparatus according to claim 35, wherein said second guide means has a press portion pressing the sheet onto said rotary convey body.

38. A sheet feeding apparatus according to claim 32, wherein said conveying means has a drive force transmitting mechanism with a speed reduction ratio.

39. A sheet feeding apparatus according to claim 32, wherein said second guide means has a rotary body pressing the sheet onto said conveying means and rotating following to the sheet conveyed by said conveying means.

40. A sheet feeding apparatus according to claim 32, further comprising record means for recording an image onto the sheet conveyed by said conveying means.

41. A sheet feeding apparatus according to claim 40, wherein said record means has an ink jet head discharging the ink.

42. A sheet feeding apparatus according to claim 41, wherein said ink jet head records the image by the ink discharged by utilizing thermal energy.

43. A sheet feeding apparatus according to claim 32, further comprising image forming means disposed downstream of said second guide means for forming an image to the sheet conveyed by said conveying means.

44. A sheet feeding apparatus, comprising:

conveying roller for applying a conveying force to a sheet;

first guide member for guiding the sheet to which the conveying force is applied by said conveying roller;

second guide member against which a tip end of the sheet guided by said first guide member abuts, for guiding the sheet in a direction changing an advancing direction of the sheet; and control portion means for controlling said conveying roller so that the conveying force of said conveying roller is changed from a first convey force to a second convey force larger than the first convey force when a tip end of the sheet is being guided by said first guide member reaches a first predetermined position upstream of said second guide member without interrupting sheet conveyance, and is changed to a third convey force smaller than the second convey force when the tip end of the sheet is being guided by said second guide member reaches to a second predetermined position downstream of an abut position where the sheet abuts said second guide member, to thereby feed the sheet to a third predetermined position under the third convey force.

45. A sheet finding apparatus according to claim 44, wherein said control portion changes the convey force by changing a convey speed for said conveying roller.

46. A sheet feeding apparatus according to claim 45, wherein said conveying roller is driven by a stepping motor.

47. A sheet feeding apparatus according to claim 44, wherein said first and second guide member guide the sheet along said conveying roller.

48. A sheet feeding apparatus according to claim 47, wherein said second guide member has a press portion pressing the sheet onto said conveying roller.

49. A sheet feeding apparatus according to claim 44, further comprising drive means having a drive force transmitting mechanism with a speed reduction ratio for driving said conveying roller.

50. A sheet feeding apparatus according to claim 44, further comprising record means for recording an image onto the sheet conveyed by said conveying roller.

51. A sheet feeding apparatus according to claim 50, wherein said record means has an ink jet head discharging the ink.

52. A sheet feeding apparatus according to claim 51, wherein said ink jet head records the image by the ink discharged by utilizing thermal energy.

53. A sheet feeding apparatus according to claim 44, further comprising image forming means disposed downstream of said second guide means for forming an image to the sheet conveyed by said conveying means.

* * * * *

UNITED STATES PATENT AND TRADEMARK OFFICE

CERTIFICATE OF CORRECTION

PATENT NO. : 5,702,191

DATED : December 30, 1997

INVENTOR(S) : Masaaki KAKIZAKI, et al.

It is certified that error appears in the above-identified patent and that said Letters Patent is hereby corrected as shown below:

Title Page, [56] References Cited - Foreign Patent Documents:

5th entry before "18282" insert --57-- -;
6th entry before "67182" insert --60-- -;
7th entry before "242086" insert -- 60-- ;
8th entry before "77964" insert -- 62-- -;
9th entry before "227672" insert --62 -- -;
11th entry before "137865" insert --63 -- -;
12th entry, before "246625", insert --63- --.

Figure 4, box 5f, delete "CARRIDGE" and insert therefor --CARRIAGE--.

Column 1, line 15, after "such", insert —a—
Line 25, delete "anASF" and insert therefor --an ASF--;
Line 42, delete "Sheet" and insert therefor --sheet--.

Column 2, line 16, after "such", insert --a--.

Column 6, line 15, delete "being".

Column 7, line 51, delete "i" and insert therefor --1--.

Column 8, line 67, delete "I" and insert therefor --1--.

UNITED STATES PATENT AND TRADEMARK OFFICE

CERTIFICATE OF CORRECTION

PATENT NO. : 5,702,191

DATED : December 30, 1997

INVENTOR(S) : Masaaki KAKIZAKI, et al.

It is certified that error appears in the above-identified patent and that said Letters Patent is hereby corrected as shown below:

Column 10, line 18, delete "1" and insert therefor --2--.

Signed and Sealed this

First Day of December, 1998

*Attest:*

*Attesting Officer*

BRUCE LEHMAN

*Commissioner of Patents and Trademarks*